United States Patent [19]

Nishimoto

[11] Patent Number: 4,476,764

[45] Date of Patent: Oct. 16, 1984

[54] AUTOMATIC PERFORMANCE APPARATUS FOR USE IN COMBINATION WITH A MANUALLY OPERABLE MUSICAL TONE GENERATING INSTRUMENT

[75] Inventor: Tetsuo Nishimoto, Shizuoka, Japan

[73] Assignee: Nippon Gakki Seizo Kabushiki Kaisha, Shizuoka, Japan

[21] Appl. No.: 409,737

[22] Filed: Aug. 19, 1982

[30] Foreign Application Priority Data

Sep. 4, 1981 [JP] Japan ..... 56-138343

[51] Int. Cl.[3] ..... G10F 1/00

[52] U.S. Cl. ..... 84/1.03; 84/DIG. 12

[58] Field of Search ..... 84/1.03, 1.01, DIG. 12, 84/1.24

[56] References Cited

U.S. PATENT DOCUMENTS 3,255,292 6/1966 Park ..... 84/1.03

4,345,501 8/1982 Nakada et al. ..... 84/1.03

*Primary Examiner*—Forester W. Isen

*Attorney, Agent, or Firm*—Remy J. VanOphem

[57] ABSTRACT

An automatic performance apparatus for use in combination with a manually operable musical tone generating instrument. The automatic performance apparatus includes a tempo signal generator, a reference timing signal generator, a tempo setting circuit and a tempo controller. The tempo controller measures the number of manual operations of the manual tone generating instrument in respective predetermined intervals before and after generation of the reference timing signal from the reference timing signal generator. The generation of the tempo signal from the tempo signal generator is controlled in accordance with the measured number obtained from the tempo controller, so that the tempo of the automatic performance is controlled.

5 Claims, 5 Drawing Figures

AUTOMATIC PERFORMANCE APPARATUS FOR USE IN COMBINATION WITH A MANUALLY OPERABLE MUSICAL TONE GENERATING INSTRUMENT

BACKGROUND OF THE INVENTION

This invention relates to an automatic performance apparatus for automatically producing such tones as auto-rhythm tones, auto-bass/chord tones, etc., and more particularly an automatic performance apparatus capable of varying the preset tempo of the automatically performed tones in relation to a variation in the operating speed of such performance operating elements as keys of one or more keyboards actuated by a performer.

As is well known in the art, an automatic performance apparatus producing auto-rhythm tones, auto-bass/chord tones, and an auto-arpeggio, and an automatic performance apparatus automatically generating a musical tone based on a prestored scale information produce the automatically performed tone at a regular speed according to a predetermined tempo. Accordingly, the automatically performed tones produced by such automatic performance apparatus are heard by listeners as mechanical musical tones which always vary at a constant speed. When such a musical tone is simultaneously produced with tones produced by depressed keys of an electronic musical instrument, even when the key operating speed is varied for the purpose of improving the musical effect, the speed of the automatically performed tone does not vary, so that it becomes impossible to keep step with the keyboard performed tone thus making it impossible to improve the musical effect.

SUMMARY OF THE INVENTION

Accordingly, it is an object of this invention to provide an automatic performance apparatus capable of improving a musical effect.

Another object of this invention is to provide an improved automatic performance apparatus suitable for incorporation into an electronic musical instrument.

Still another object of this invention is to provide an automatic performance apparatus that can change the tempo of the automatic performance tones such as automatic arpeggio tones and rhythm tones.

Yet another object of this invention is to provide an electronic musical instrument incorporated with an improved automatic performance apparatus in which musical tones produced by the electronic musical instrument and the automatic performance apparatus always keep step thus improving the overall musical effect.

According to the present invention, an automatic performance apparatus for use in combination with a manually operable musical tone generating instrument is provided, which includes a tempo signal generator for generating a tempo signal, an automatic performance tone forming circuit for forming automatic performance tones in response to the tempo signal, a reference timing signal generator for generating a reference timing signal, a tempo setting circuit for setting the tempo of the automatic performance tones, and a tempo controller connected to the tempo setting circuit and the reference timing signal generator for measuring the number of state change signals generated responsive to manual operations of the musical tone generating instrument in respective predetermined intervals before and after generation of the reference timing signal and for modifying the set tempo in accordance with the measured number of state change signals.

DESCRIPTION OF THE PREFERRED EMBODIMENT

Figure 1:
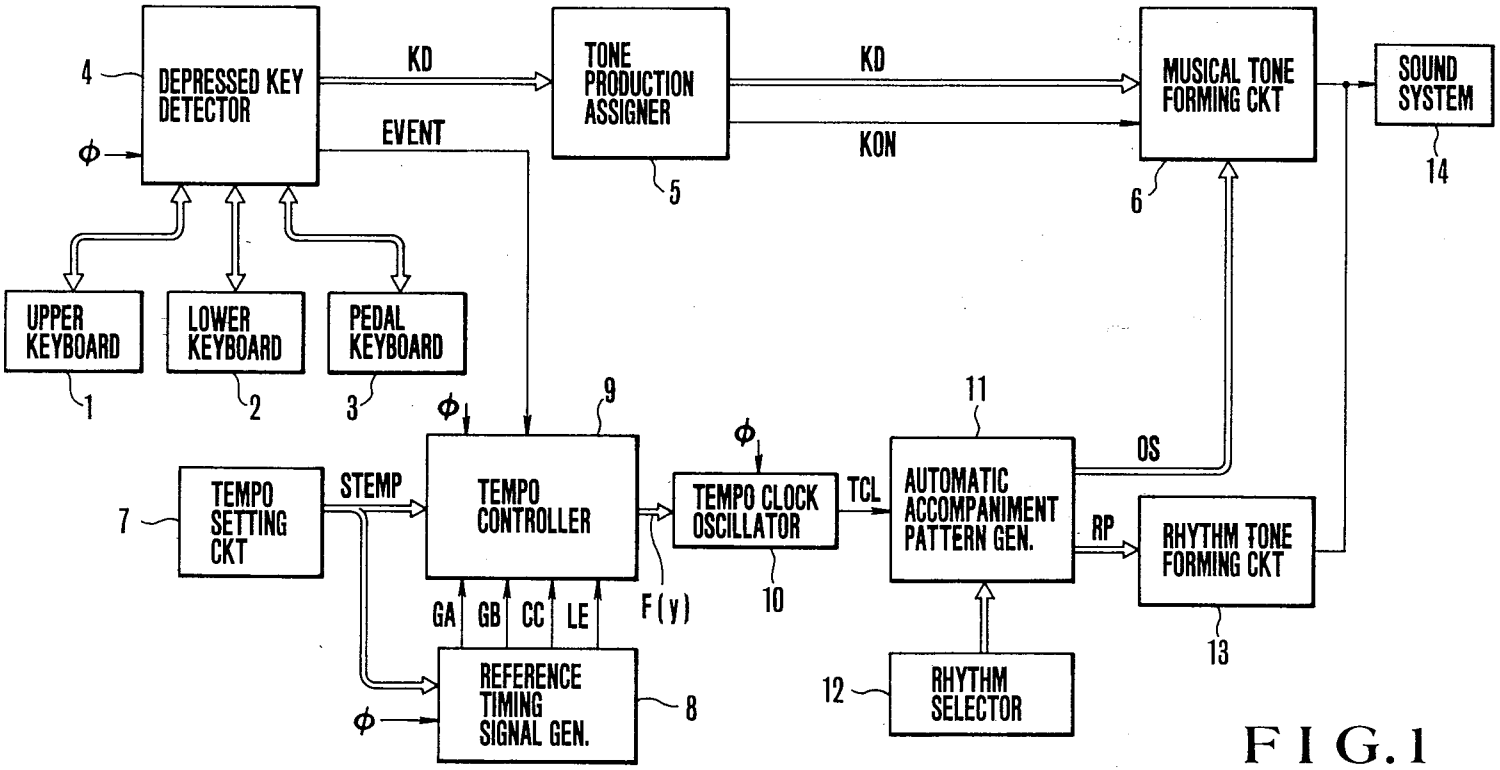
FIG. 1 is a block diagram showing one embodiment of this invention applied to an electronic musical instrument.

The automatic performance apparatus of this invention, as applied to an electronic musical instrument and shown in FIG. 1 includes an upper keyboard 1, a lower keyboard 2, a pedal keyboard 3, a depressed key detector 4, a tone production assignor 5, a musical tone forming circuit 6, a tempo setting circuit 7, a reference timing signal generator 8, a tempo controller 9, a tempo clock oscillator 10, an automatic accompaniment pattern generator 11, a rhythm selector 12, a rhythm tone forming circuit 13 and a sound system 14.

Each of the upper keyboard 1, the lower keyboard 2 and the pedal keyboard 3 is provided with a plurality of key switches which are actuated when keys associated therewith are depressed. The operations of the key switches are detected by the depressed key detector 4.

The depressed key detector 4 detects actuated key switches of the upper keyboard 1, the lower keyboard 2 and the pedal keyboard 3 to form key informations KD corresponding to the note pitches of the depressed keys in accordance with the output signals of the respective actuated key switches. Each key information KD is represented by a keyboard code KBC representing the type of the keyboard, an octave code OC representing the note range of the key, and a note code NC representing the note name and supplied to the tone production assigner 5.

Furthermore, the depressed key detector 4 detects depression and release of the keys of the upper, lower and pedal keyboards, 1, 2 and 3, respectively to produce a state variation signal that is an event signal EVENT of the key operation showing that the performance state has changed on the upper, lower and pedal keyboards, 1, 2 and 3, respectively. The event signal EVENT is supplied to the tempo controller 9.

The tone production assigner 5 assigns tone production of a musical tone signal corresponding to the key information KD supplied from the depressed key detector 4, to an available one of a plurality of time divisioned tone production channels in the musical tone forming circuit 6 so as to produce, on the time division basis, a key information of the depressed key at the channel timing corresponding to the assigned channel. In this embodiment, there are twelve time divisioned tone production channels. The tone production of the musical tone corresponding to a depressed key of the pedal keyboard 3 is assigned only to the first channel, while the tone production of the musical tone corresponding to the depressed keys of the upper keyboard 1 and the lower keyboard 2 is assigned to an available one of the second through twelfth channels. The tone production assigner 5 outputs a key-on signal that controls the production of a musical tone assigned to respective tone production channels in synchronism with the time divisioned output timing of the key information, the output key-on signal KON being applied to the musical tone forming circuit 6.

As described above, the musical tone forming circuit 6 includes twelve time divisioned tone production channels, for example, and when it is supplied with a key information KD of a depressed key from the tone production assigner 5 in synchronism with the tone production assignment timing, the respective tone production channels form musical tone signals corresponding to the information KD. The musical tone signals produced by respective tone production channels are synthesized each time when the twelve tone production channel timings complete one cycle to output a synthesized musical tone signal of a musical tone assigned to all tone production channels, which is then supplied to the sound system 14. As a consequence, the sound system 14 simultaneously produces a musical tone corresponding to a maximum of twelve depressed keys. The musical tone signals produced by the respective tone production channels are applied with amplitude envelopes respectively ranging from an attack to a decay by envelope waveform signals generated in synchronism with the key-on signals of the respective tone production channels.

When supplied with an information OS representing an octave shift quantity of an automatic arpeggio tone, for example, from the automatic accompaniment pattern generator 11, the musical tone forming circuit 6 shift the octave of the musical tone signals formed by the respective tone production channels by an amount designated by the information OS. The information OS varies at each time interval T of the timing signal formed in the circuit of the automatic accompaniment pattern generator based on a tempo clock TCL generated by the tempo clock oscillator 10. For example, the octave of a musical tone corresponding to a depressed key is shifted to the first, second and third octaves at intervals T and then returned to the second and first octaves of the depressed key from the third octave. Thus, the musical tone signals formed by the respective tone production channels are produced as automatic arpeggio tones with their octaves sequentially shifted according to the information OS. In addition to an information for producing the automatic arpeggio tone, the automatic accompaniment pattern generator 11 generates a rhythm pattern information RP adapted to generate a rhythm tone corresponding to a rhythm selected by the rhythm selector 12. The generated rhythm pattern information RP is supplied to the rhythm tone forming circuit 13 which forms a rhythm tone signal based on the rhythm pattern information RP and supplies the rhythm tone signal to the sound system 14. Since the circuit is constructed to cause the rhythm pattern information RP to vary at a speed corresponding to the tempo clock TCL the sound system 14 produces a rhythm tone which changes at a speed corresponding to the tempo clock TCL.

Consequently, after a rhythm corresponding to a performed music is selected by the rhythm selector 12, where keys of the upper, lower and pedal keyboards 1, 2 and 3, respectively, are operated the performed tones are produced as automatic arpeggio tones added with rhythm tones.

As described above, the speeds of variations of the automatic arpeggio tones and the rhythm tones are controlled by the period of the tempo clock TCL, and the period of the tempo clock is controlled by the tempo controller 9 in accordance with the variation in the performance operations of the upper, lower and pedal keyboards, 1, 2 and 3.

Figures 2A, 2B, 2C, 2D, 2E, 2F:
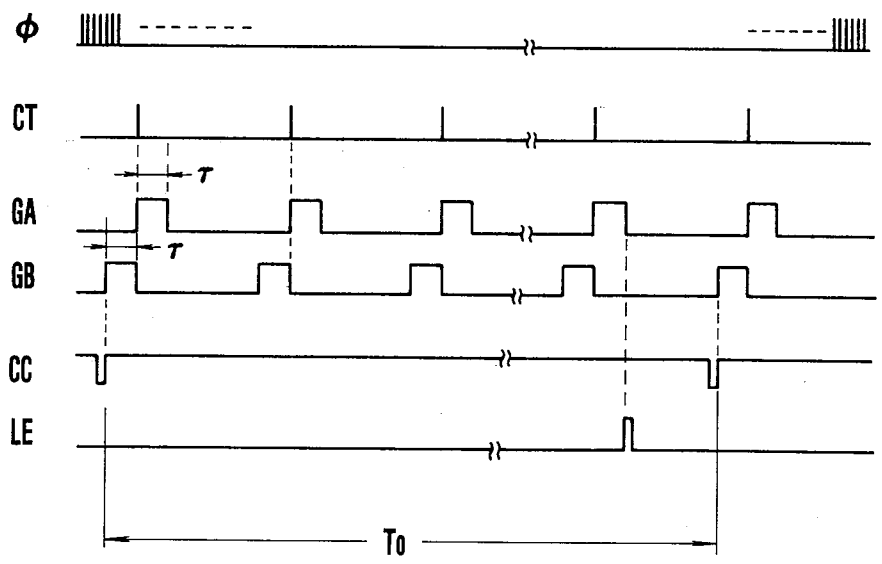
FIG. 2 is a timing chart useful to explain the operation of the embodiment shown in FIG. 1.

More particularly, when a desired tempo is set, a tempo setting circuit 7 supplies a set tempo information STEMP representing the set tempo to the tempo controller 9 and the reference timing signal generator 8. Then, as shown by the timing chart shown in FIG. 2A, the reference timing signal generator 8 divides the frequency of a master clock $\phi$ corresponding to the set tempo information STEMP to form a reference timing signal CT, shown in FIG. **2*b* and then forms first and second reference timing signals GA and GB immediately before and after the reference timing signal CT. Each first and second reference timing signal GA and GB has a width of T and supplies the first and second timing signals thus formed to the tempo controller 9. FIGS. 2*c* and 2*d*** show the waveforms of the first and second reference timing signals GA and GB, respectively.

Furthermore, as shown in FIGS. **2*e* and 2*f*, the reference signal generator 8 produces one clear signal CC and one latch control signal LE per n signals GA and GB. The clear signal CC is used to clear the number of generations of the event signal EVENT in a predetermined interval $T_o$ measured by the tempo controller 9** for enabling measurement of the number of generations of the event signal EVENT during a new predetermined interval. The clear signal CC is generated at the beginning of each interval. The latch control signal LE is used to store the number of generations of the event signal EVENT measured during the interval $T_o$ and is generated at the end portion of each interval $T_o$.

In response to the first and second reference timing signals GA and GB, the clear signal CC, and the latch control signal LE supplied from the reference timing signal generator 8, the tempo controller 9 measures the number of generations of the event signal EVENT output from the depressed key detector 4 in predetermined intervals $T_o$ before and after the generation of the reference timing signal CT for controlling the period of the tempo clock TCL set by the set tempo information in accordance with the difference between the number of generations of the signal EVENT before generation of the reference timing signal CT (termed pre-event number) and the number of generations of the signal EVENT after generation of the reference timing signal CT (termed post-event number).

Figure 3:
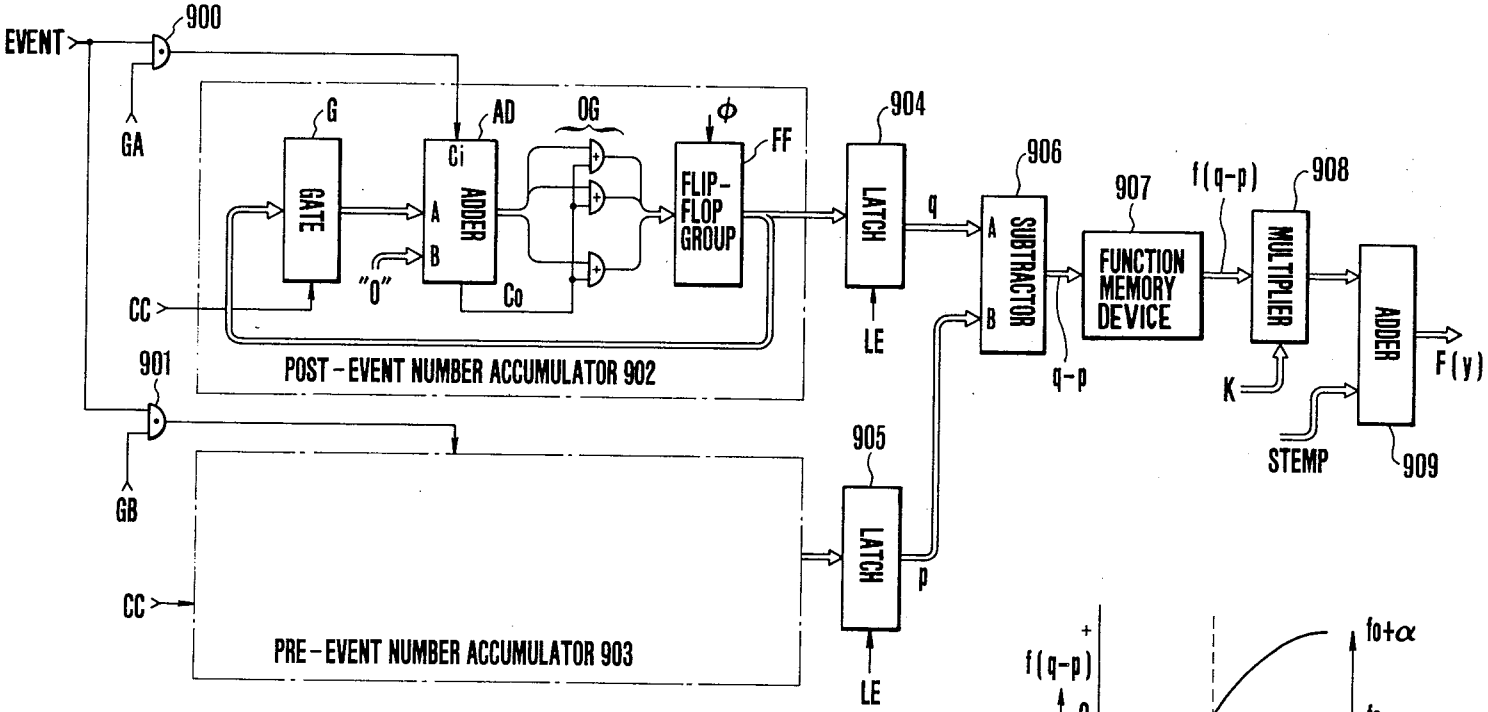
FIG. 3 is a connection diagram showing the detail of the tempo controller shown in FIG. 1.

FIG. 3 shows the construction of the tempo controller 9 which includes an AND gate circuit 900 which is enabled, while the first timing signal GA is "1", to supply the event signal EVENT to a post-event number accumulator 902. There is also provided an AND gate circuit 901 which is enabled, while the second reference timing signal GB is "1", to supply the event signal to an pre-event number accumulator 903. The post-event number accumulator 902 and the pre-event number accumulator 903 respectively count the post-event numbers and the pre-event numbers in an interval $T_o$ between the generation of a clear signal CC and the generation of the next clear signal CC, and respectively consists of an adder AD, an OR gate group OG and a, parallelly connected flip-flop group FF each including a plurality of bits and a gate circuit G. The post-event number accumulator 902 and the pre-event number accumulator 903 have the same construction so that only the post-event number accumulator 902 is shown in detail and will be described herein. When a clear signal CC is generated at the beginning of a predetermined interval $T_o$, the gate circuit G that feeds back the outputs of the flip-flop group FF to the input A of the adder AD is disabled so that the output of the gate circuit G becomes "0". Since "0" is always input into the input B of the adder AD, when the output of the gate circuit G becomes "0", the output of the adder AD will also become "0". The output of the adder AD is supplied to the flip-flop group FF via the OR gate group OG. When the carry output signal $C_o$ of the adder AD is "0", the OR gate group OG pass the output of the adder AD as it is, whereas when the output of the adder AD releases a maximum value so that the carry output signal $C_o$ becomes "1", this carry output signal is applied in parallel to respective OR gate group to change all bits of the output of the adder AD to "1" and then supply them to the flip-flop group FF. More particularly, when the post-events occur in a number larger than a number that can be added by the adder AD so that the output of the adder AD becomes "0" and a carry output signal $C_o$ is generated, the OR gate group OG makes the output of the adder AD a maximum (all bits are "1"), thus functioning as a limiter preventing the output of the adder from returning to "0". Accordingly, at the time of generating a clear signal CC, since inputs to the adder AD are both "0", carry output signal $C_o$ would become "0". For this reason, output "0" of the adder passes through the OR gate group OG as it is and is then supplied to the flip-flop group FF. Then, the flip-flop group FF stores the "0" output of the adder each time the master clock $\phi$ is generated and holds this value until a next new value is supplied. In other words, upon generation of a clear signal CC, the content of the flip-flop group FF is cleared to "0".

After generation of the clear signal CC, the first reference timing signal GA (see FIG. 2*c*), having a width of $\tau$, becomes "1" to enable the AND gate circuit 900. When an event signal EVENT is generated while the AND gate circuit 900 is enabled, this event signal EVENT is applied to the carry input terminal Ci of the adder AD via the AND gate circuit 900. At this time, since no clear signal OC is generated, the gate circuit G is enabled to feedback the output "0" of the flip-flop group FF to the input A of the adder AD. Accordingly, in response to the first event signal EVENT, the output of the adder AD becomes "1" and is then supplied to the flip-flop group FF via the OR gate group OG. This output "1" of the adder is stored in the flip-flop group FF at the time of generating the master clock $\phi$, whereby the content of the flip-flop group changes from "0" to "1". Such an addition operation is operated similarly for successively generated event signals EVENT and is repeated each time the first reference timing signal GA, having a width $\tau$, is generated in the predetermined intervals $T_o$. Then, the flip-flop group FF produces an accumulated value of the event signals EVENT generated in the intervals in which n first reference timing signals have been generated, that is a post-event number q which is latched in the latch circuit 904 according to a latch control signal LE generated at an end of a predetermined interval $T_o$.

In the same manner, the pre-event number accumulator 903 produces an accumulated number p of the event signals (that is the pre-event number p) generated in an interval in which n second reference timing signals GA have been generated in the predetermined interval $T_o$ and the pre-event number p thus obtained is stored in a latch control circuit 905 according to a latch signal LE.

The post-event number q and the pre-event number p respectively latched by the latch circuit 904 and 905 are input to a subtractor 906 to obtain their difference q−p which is supplied to a function memory device 907 to act as an address signal.

Figure 4:
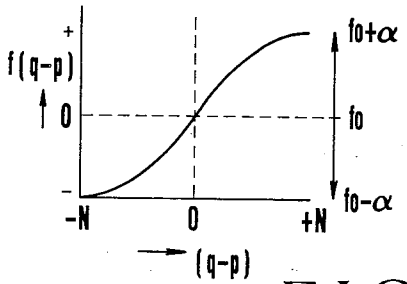
FIG. 4 is a graph showing the content of the function member shown in FIG. 3.

The function memory device 907 stores at its addresses the function f(q−p) for correcting the predetermined period of the tempo clock TCL in accordance with the difference q−p. For example, as shown in FIG. 4, the function memory device 907 stores a function f(q−p) that proportionally corrects the period of the tempo clock TCL between the positive and negative maximum values +N and −N of the difference q−p in a range of $\pm\alpha$about the set period $T_{tp}$.

Consequently, when the difference q−p between the post-event number q and the pre-event number p is supplied from the subtractor 906 to act as an address signal, the function memory device 907 outputs the function f(q−p) that corrects the period of the tempo clock TCL about the set period $T_{tp}$ according to the difference q−p.

The function f(q−p) is multiplied with a coefficient K in a multiplier 908 to produce a function K·f(q−p) which is applied to an adder 909.

The set tempo information STEMP output from the tempo setter 7 is applied to one input of the adder 909 and the function K·f(q−p) output from the multiplier 908 for correcting the period of the tempo clock TCL is applied to the other input of the adder 909 so that the adder adds the information STEMP to the function K·f(q−p). Denoting the set tempo value represented by the content of the information STEMP by g(x) (x represents the position of the tempo setting variable resistor), the adder 909 would produce a sum F(y) expressed by an equation $$F(y)=g(x)+K\cdot f(q-p) \quad (1).$$

This sum F(y) is supplied to the tempo clock oscillator 10 shown in FIG. 1 as a signal for setting the period of the tempo clock TCL. Accordingly, the tempo clock oscillator 10, which divides the frequency of the master clock $\phi$ to form the tempo clock TCL, divides the frequency of the master clock $\phi$ at a frequency division ratio designated by the sum F(y) provided by the adder 909 to produce a tempo clock TCL having a frequency $f_o$ (period $1/f_0$=TLP) expressed by $$f_o = \frac{K_o \cdot f_\phi}{g(x) + K \cdot f(q-p)} \quad (2)$$

where $K_o$ is a constant, and $f_{100}$ represents the frequency of the master clock $\phi$.

In summary, where the performance operation of the upper, lower and pedal keyboards, 1, 2 and 3, respectively, is slightly slower than the set tempo g(x) q becomes larger than p (q>p) so that the frequency $f_o$ of the tempo clock TCL is shifted to the lower frequency according to the difference q−p between the post-event number q and the pre-event number p. Conversely, where the performance operation becomes slightly faster than the set tempo g(x) q becomes smaller than p (q<p) so that the frequency $f_o$ of the tempo clock TCL would be shifted to a higher frequency according to the difference q−p.

Consequently, both the automatic arpeggio tone and the rhythm tone vary in proportion to the variation in the speed of the performance operation of the upper, lower and pedal keyboards 1, 2 and 3, thus eliminating mechanical audition of the automatic arpeggio tones and the rhythm tones thereby enriching the musical effect.

Although in the illustrated embodiment, an information for correcting the period of the tempo clock was obtained by utilizing the function memory device 907, such correction information can be produced by an arithmetic operating circuit that operates equation (2). Furthermore, instead of correcting the period of the tempo clock TCL in accordance with the difference q−p between the post-event number q and the pre-event number p, such a correction may also be made by a ratio q/p, in which case the frequency $f_o$ of the tempo clock TCL is determined by an equation $$f_o = \frac{K_o \cdot f_\phi}{g(x) + K \cdot \frac{q+\alpha}{p+\beta}} \quad (3)$$

In equation (3) $\alpha$ and $\beta$ are suitably selected constant for preventing the numerator and the denominator of $$\frac{q+\beta}{p+\alpha}$$

from becoming zero.

Figure 5:
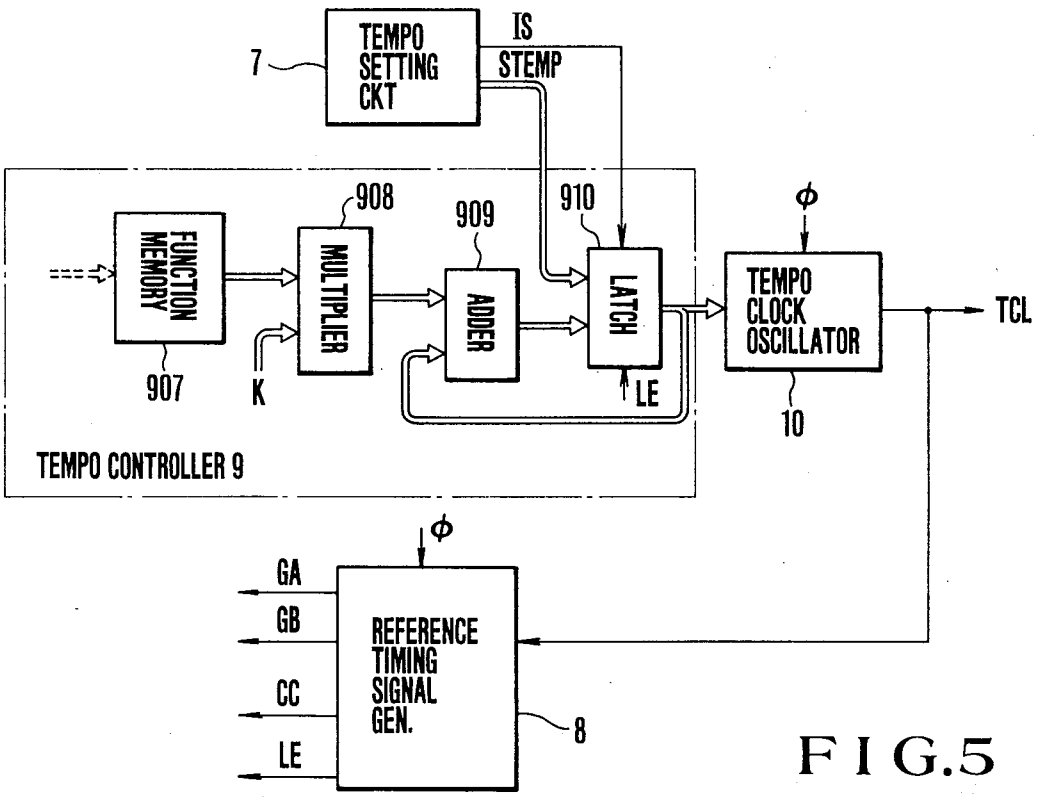
FIG. 5 is a block diagram showing another example for variably controlling the tempo clock of the embodiment shown in FIG. 1.

Although in FIGS. 1 and 3, the reference timing signals CT, GA and GB were produced by taking the set tempo as the reference, these reference timing signals can be produced by taking the tempo clock TCL as the reference where the tempo setting circuit 7, the reference timing signal generator 8 the tempo controller 9 and the tempo clock oscillator 10 are connected as shown in FIG. 5.

More particularly, in FIG. 5, a latch circuit 910 is added on the output side of the adder 909 of the tempo controller 9 shown in FIG. 3, and a set tempo information STEMP output from the tempo setting circuit 7 is set in the latch circuit 910 as an initial value in accordance with an initial set signal IS which represents that a new tempo has been set. The output of the latch circuit 910 is supplied to the tempo clock oscillator 10 and also fed back to the input of the adder 909 to be added to the output of the multiplier 908. The output of the adder 909 is latched in the latch circuit 910 according to the latch control signal LE. The tempo clock TCL is fed back to the reference timing signal generator 8, which is constructed to form the first and second reference timing signals GA and GB, the clear signal CC and the latch control signal LE, by utilizing the tempo clock TCL as a reference. With this modification, any change in the performance operation of the upper, lower and pedal keyboards 1, 2 and 3 is compared with a variation in an immediately preceding interval $T_o$. In other words, the period of the tempo clock TCL is controlled to be faster or slower than a preceding tempo.

Although in the foregoing embodiments generation of the automatic arpeggio tones and rhythm tones was described, it should be understood that the invention is also applicable to such electronic musical instruments in which an auto-bass/chord tone or a note pitch and code length data are prestored for automatically producing musical tones by utilizing the prestored data. Although the invention has been described relative to an automatic performance apparatus incorporated into an electronic musical instrument, the invention is also applicable to an apparatus which has only the automatic performance capability, wherein a signal corresponding to an event signal indicating a change of the operating condition of the keys is input from outside and the tempo of the automatic performance tone is changed according to the change of the signal.

As described above in the automatic performance apparatus of this invention, the number of operations of the performance operators near a reference timing, is measured before and after a reference timing, so as to control a tempo preset according to the measured values, by taking into consideration the fact that when it is desired to increase the performance speed, the performance operators or keys are operated at a time slightly earlier than a reference timing provided coresponding to a set tempo. On the other hand when it is desired to decrease the performance speed the performance operators should be operated at a time slightly later than the reference timing.

Accordingly, the tempo of the automatic performance tones, such as rhythm tones, can be changed following a change of the operating speed of the performance operators such as keys, thus enriching the musical effect.

What is claimed is:

1. An automatic performance apparatus for use in combination with a manually operable musical tone generating instrument comprising:

a tempo setting circuit for generating a tempo information signal in response to a manually selected tempo;

a tempo signal generator for generating a tempo signal in response to said tempo information signal;

automatic performance tone forming circuit means for generating automatic performance tones in response to said tempo signal;

reference timing signal generator means responsive to a signal indicative of said selected tempo for generating reference timing signals; and tempo controller means responsive to said tempo information signal and said reference timing signals for modifying said tempo information signal as a function of the difference between the number of manual operating events of said musical tone generating instrument within predetermined time intervals immediately preceding each of said reference timing signals and the number of manual operating events of the musical tone generating instrument within predetermined time intervals immediately following each of said reference timing signals, said modified tempo information signal controlling the tempo of the tempo signal generated by the tempo signals generator in a direction towards the tempo of the manual operating events of said musical tone generating instrument.

2. An automatic performance apparatus according to claim 1 wherein said signal indicative of said selected tempo is said tempo signal.

3. An automatic performance apparatus according to claim 1 wherein said signal indicative of said selected tempo is said tempo information signal.

4. An automatic performance apparatus according to claim 1 wherein said manually operable musical tone generating instrument comprises an electronic musical instrument having a keyboard generating said manual operating events.

5. An automatic performance apparatus according to claim 1 wherein said tempo controller means modifies said tempo information signal based upon said number of manual operating events obtained from a plurality of predetermined time intervals.

* * * * *

UNITED STATES PATENT AND TRADEMARK OFFICE

CERTIFICATE OF CORRECTION

PATENT NO. : 4,476,764

DATED : October 16, 1984

INVENTOR(S) : Tetsuo Nishimoto

It is certified that error appears in the above-identified patent and that said Letters Patent is hereby corrected as shown below:

Column 2, line 16, delete "member" and insert ---- memory ----.

Column 3, line 18, after "the" insert ---- key ----.

Column 3, line 38, delete "shift" and insert ---- shifts ----.

Column 4, line 2, after "operated" insert a comma ---- , ----.

Column 4, line 20, after "2b" insert a comma ---- , ----.

Column 6, line 2, delete "a" and insert ---- the ----.

Column 6, line 6, delete "GA" and insert ---- GB ----.

Column 6, line 60, delete "$f_{100}$" and insert ---- $f_{\phi}$ ----.

Column 7, line 17, delete "(2)" and insert ---- 2 ----.

Column 7, line 29, delete "(3)" and insert ---- 3 ----. Same line, delete "constant" and insert ---- constants ----.

Signed and Sealed this

*Twenty-fifth* Day of *June 1985*

[SEAL]

*Attest:*

DONALD J. QUIGG

*Attesting Officer* *Acting Commissioner of Patents and Trademarks*